United States Patent [19]

Hanson

[11] 4,090,858

[45] May 23, 1978

[54] TWO-STAGE SPLIT-CYCLE COOLER WITH PNEUMATIC PISTON

[75] Inventor: Charles M. Hanson, Springfield, Va.

[73] Assignee: The United States of America as represented by the Secretary of the Army, Washington, D.C.

[21] Appl. No.: 773,032

[22] Filed: Feb. 28, 1977

[51] Int. Cl.[2] ..... F25B 9/00

[52] U.S. Cl. ..... 62/6

[58] Field of Search ..... 62/6

[56] References Cited

U.S. PATENT DOCUMENTS

| | | | |
|---|---|---|---|
| 3,423,948 | 1/1969 | Cowans | 62/6 |
| 3,472,037 | 10/1969 | Kohler et al. | 62/6 |
| 3,933,000 | 1/1976 | Doody | 62/6 |
| 4,036,027 | 7/1977 | Bamberg | 62/6 |

*Primary Examiner*—Lloyd L. King

*Attorney, Agent, or Firm*—Nathan Edelberg; Aubrey J. Dunn; Robert P. Gibson

[57] ABSTRACT

A Stirling-cycle refrigerator including a compressor portion having two cylinders with respective pistons therein, and an expansion portion with a cylinder having first and second distinct spaces, and with opposite ends of an expansion piston in the distinct spaces. The two cylinders of the compressor portion are connected by respective refrigerant conduits to the two spaces of the expansion portion. The end of the expansion piston in the first space has a regenerator therein. The two pistons of the compressor are driven 180° out of phase, whereby the respective conduits simultaneously induce compression in the first expansion portion space and expansion in the second. The conduit between the second space and the respective compressor cylinder additionally includes a regenerator.

2 Claims, 1 Drawing Figure

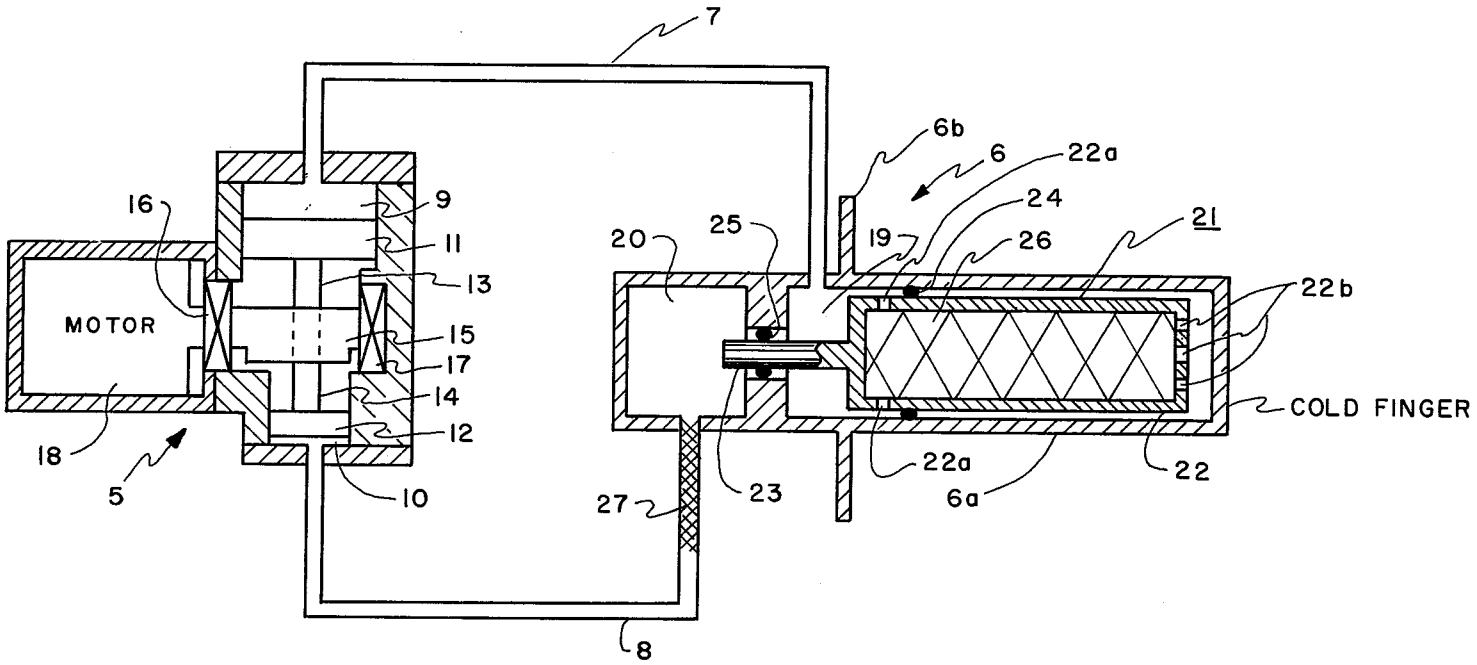
COLD FINGER
22b
21
22
22a
24
26
6
6b
19
6a
22a
25
23
7
20
27
8
9
11
13
15
17
14
12
10
16
MOTOR
5
18

TWO-STAGE SPLIT-CYCLE COOLER WITH PNEUMATIC PISTON

The invention described herein may be manufactured, used, and licensed by the U.S. Government for governmental purposes without the payment of any royalties therein.

BACKGROUND OF THE INVENTION

This invention is in the field of split-cycle Stirling-cycle coolers which generally have a compression portion and expansion portion connected by a refrigerant conduit. The expansion portion has a "cold finger" in which expansion of the refrigerant occurs. This cold finger has an ambient end from which the refrigerant flows towards a cold end. Thus a temperature gradient exists from the ambient to the cold end of the finger. Typical of such coolers are those shown in the U.S. Pat. Nos. 3,630,041, 3,862,546, and 3,877,239. An improvement in operation of such typical coolers could be realized if the temperature gradient along the cold finger were reduced. The present invention is able to reduce this gradient by providing a cooling stage for the ambient end of the cold finger.

SUMMARY OF THE INVENTION

The invention is an improved Stirling-cycle cooler of the split-cycle type wherein two stages are used for better cooling. One stage employs a first compressor piston and cylinder connected by a first refrigerant conduit to a first expansion space. This expansion space has one end of an expansion piston therein, with a regenerator inside said one end. The other cooler stage employs a second compressor piston and cylinder connected by a second refrigerant conduit to a second expansion space. This second expansion space has the other end of said expansion piston therein. The second conduit has a regenerator therein. The two compressor pistons are driven from a common motor, but at a 180° phase difference. This phase difference insures that one end of the expansion piston is under suction while the other end is under compression, and conversely.

BRIEF DESCRIPTION OF THE DRAWINGS

The single drawing FIGURE shows a diagramatic view of the invention.

DETAILED DESCRIPTION OF THE INVENTION

The invention may perhaps be best understood by referring to the drawings, which includes compressor portion 5, expansion portion 6, and refrigerant conduits 7 and 8. Portion 5 includes first and second cylinders 9 and 10 with respective pistons 11 and 12 therein. Pistons 11 and 12 are connected by arms 13 and 14 to crankshaft 15 supported by bearings 16 and 17. Motor 18 turns crankshaft 15. Rods 13 and 14 are mounted to crankshaft 15 such that pistons 11 and 12 move in the same direction as 15 rotates. This gives a 180° phase difference in the compression-expansion cycles in cylinders 9 and 10. I.e., the refrigerant in cylinder 9 is undergoing compression at the same time that refrigerant in cylinder 10 is being expanded, and conversely. Conduits 7 and 8 respectively connect cylinders 9 and 10 to spaces 19 and 20 in expansion portion 6. This expansion portion includes housing *6a* with flange *6b* and an expansion piston 21 respectively having end 22 and smaller end (pneumatic piston) 23 in respective spaces 19 and 20. Piston 21 is supported by and sealed in housing *6a* by seals fixed in housing *6a*. The seals may be seated in grooves (not shown) in *6a* or in 21. As can be seen in the drawings, end 22 of piston 21 is hollow, with openings *22a* and *22b* communicating with the interior space of 21. This interior space is filled with material 26 which acts as a regenerator, in the usual manner. Conduit 8 also contains regenerator 27 therein. Although I have described compressor 5 as including two separate cylinders and pistons, a single cylinder and piston may be used, with a sealed crankcase acting as a second cylinder-piston.

OPERATION OF INVENTION

Expansion portion 6 of the drawing is the cooling portion of the invention, with the right end of housing *6a* being the "cold finger" part. This housing is inserted in the region to be cooled, with flange *6b* seated against a wall of the cooled region. The flange is thus at the ambient zone of the cooler. It is assumed that the cooler contains a proper refrigerant. In FIG. 1, upward movement of the pistons allows the refrigerant to be compressed by piston 11 in cylinder 9, to pass through conduit 7 and into regenerator 26 in space 19. Cylinder 21 tends to move to the left. Net heat is extracted from the volume at the right end of space 19 (second stage) and rejected at the volume at the left end of space 19. Simultaneously, as a result of the motion of piston 12, heat is extracted from volume 20 (first stage) and rejected in volume 10, thus reducing the temperature at the left end of 6. The amount of heat extracted from volume 20 is approximately proportional to the diameter of the pneumatic piston 23. The tandem arrangement of the two cooling states of the invention provides improved cooling by reducing the thermal gradiant along the cold finger, since thermodynamic losses are proportional to such gradiant.

I claim:

1. A two-stage split-cycle mechanical cooler having a compression portion, a distinct expansion portion, and conduit means between said portions: said compression portion including a first piston in a first cylinder and a second piston in a second cylinder, and means for reciprocally moving said pistons in said cylinders in phase opposition; said expansion portion including a third cylinder having distinct first and second spaces, a third piston in said third cylinder having opposite ends respectively in said first and second spaces, and a regenerator in said end of said third cylinder which is in said first space of said third cylinder; and said conduit means including first and second conduits respectively connecting said first cylinder to said first space and said second cylinder to said second space, wherein said second conduit includes a regenerator therein.

2. The cooler as defined in claim 1 wherein said first and second cylinders are of different diameters.

* * * * *